United States Patent [19]

Achelpohl et al.

[11] 4,226,458

[45] Oct. 7, 1980

[54] LIFTING TACKLE FOR FILLED SACKS

[75] Inventors: Fritz Achelpohl; Konrad Tetenborg, both of Lengerich, Fed. Rep. of Germany

[73] Assignee: Windmoller & Holscher, Lengerich, Fed. Rep. of Germany

[21] Appl. No.: 937,522

[22] Filed: Aug. 28, 1978

[30] Foreign Application Priority Data

Sep. 26, 1977 [DE] Fed. Rep. of Germany ..... 2743208

[51] Int. Cl.[2] ..... B66C 1/42

[52] U.S. Cl. ..... 294/88; 294/103 R; 414/607; 414/621

[58] Field of Search ..... 294/1 R, 74, 83 A, 86 R, 294/88, 103 R, 104; 24/68 R, 68 A, 71.2, 136 K, 197, 269, 265 R; 224/45 H, 54; 242/74.1; 254/161; 414/607, 608, 618–622

[56] References Cited

U.S. PATENT DOCUMENTS

| | | | |
|---|---|---|---|
| 824,904 | 7/1906 | Cammett et al. | 294/103 R X |
| 2,327,139 | 8/1943 | Scott | 24/136 K X |
| 2,607,560 | 8/1952 | Bugg | 254/161 X |
| 2,874,431 | 2/1959 | Elsner | 24/71.2 X |
| 3,120,403 | 2/1964 | Molzan et al. | 294/74 |
| 3,143,233 | 8/1964 | Evans et al. | 414/621 X |
| 3,937,394 | 2/1976 | Netschert | 224/45 H X |

FOREIGN PATENT DOCUMENTS

| | | | |
|---|---|---|---|
| 2607909 | 9/1976 | Fed. Rep. of Germany | 294/103 R |

*Primary Examiner*—Johnny D. Cherry
*Attorney, Agent, or Firm*—Fleit & Jacobson

[57] ABSTRACT

Lifting gear for a filled sack comprises a pair of clamping bars between which the gathered and flattened mouth portion of the sack can be clamped after the mouth portion has been slung thereabout. The bars are in the form of parallel cantilever arms and rotatable about an axis parallel thereto, one of the bars also being displaceable to and from the other bar while remaining parallel thereto.

9 Claims, 8 Drawing Figures

LIFTING TACKLE FOR FILLED SACKS

The invention relates to apparatus for lifting a filled sack, comprising a pair of clamping bars about which the gathered and flattened end of the sack is slung, the pair of clamping bars being rotatable about an axis parallel to the bars to a terminal position at which the end of the sack is clamped tight and one of the clamping bars being displaceable towards the other in parallel relationship. Apparatus of this type are described in U.S. patent application Ser. No. 841,380, filed Oct. 12, 1977, now U.S. Pat. No. 4,181,345.

In the lifting gear according to the referenced application, the clamping bars are arranged at both ends between lugs rotatably mounted in a supporting frame, one of the clamping bars being displaceable in grooves and freely rotatable. To suspend the sacks, the end of the sack is introduced between the clamping bars by hand and the lugs are manually turned by way of a crank so that the end of the sack is slung about the clamping bars in loop formation. Although the lifting tackle described in the referenced application is able to hold filled sacks securely, suspension in the lifting tackle is cumbersome because the end of the sack has to be manually pushed between the clamping bars.

It is therefore the problem of the present invention to improve the apparatus according to the referenced applicaton in a manner such that the apparatus is easier to manipulate and the sacks can be more easily suspended therefrom.

This problem is solved according to the invention in that the clamping bars are held in their mountings only on one side such that they form parallel cantilever arms. The apparatus according to the invention permits the folded ends of upright sacks to be engaged by moving the clamping bars axially, thereby eliminating the manual operation that would otherwise be necessary to indroduce the end of the sack between the clamping bars. The apparatus according to the invention can therefore be advantageously used in conjunction with forklift trucks, particularly if the axes of the clamping bars are in alignment with the direction of travel of the forklift truck. The necessary pivotal motion of the clamping bars can be carried out by the driver of the forklift truck as soon as he has engaged with the clamping bars the end of the sack that has been pushed therebetween.

Preferably, one clamping bar is pivotable about the axis of the other bar as well as radially thereto and can be locked in its closed position. This brings about a simple construction for the apparatus.

Desirably, the pivotal motion of the clamping bars or their locking is carried out by hydraulic units. Locking in the closed position can also be effected by the hydraulic units that execute the pivotal motion.

The hydraulic units may be actuated by the driver of the forklift truck so that the filled sacks can be loaded with fewer personnel.

Other advantageous embodiments of the invention are described in more detail in the subsidiary claims.

An example of the invention will be described in more detail with reference to the drawing, wherein.

Figure 1:
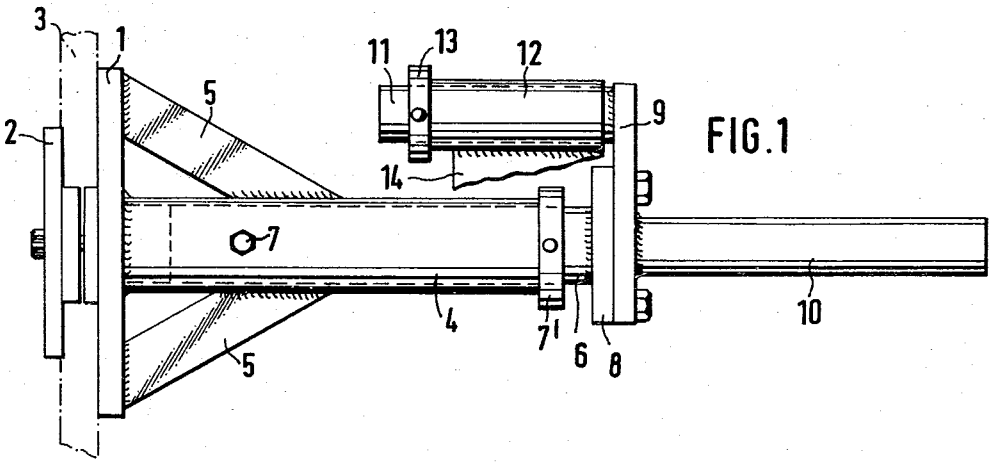
FIG. 1 is a side elevation of the manually actuatable lifting tackle.
Figure 2:
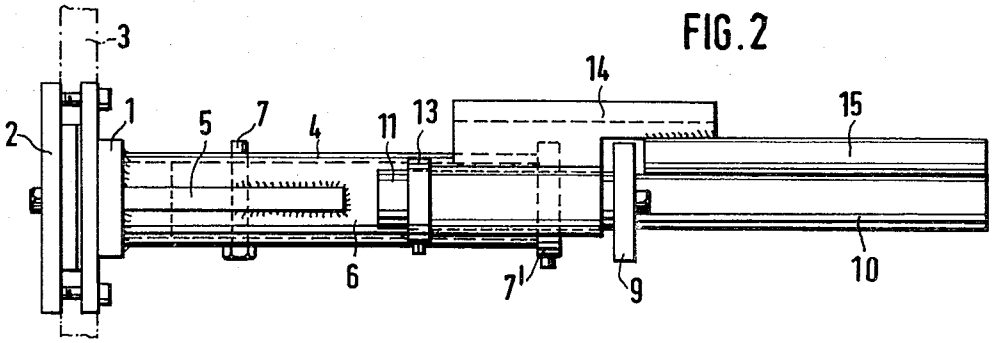
FIG. 2 is a plan view.

The lifting apparatus is secured to a retaining plate 1 which permits its mounting for example on a forklift truck. The plate 1 is associated with a backing plate 2 and both are bolted for example to the frame 3 of a forklift truck and clamp the frame therebetween. A tube 4 is welded to the plate 1 and braced by anchoring plates 5. A shaft 6 rotatably mounted in the tube 4 can be secured against rotation by means of a plug pin 7 introduced in aligned holes through the tube 4 and the shaft 6. A setting ring 7' clamped to the shaft 6 lies against the end of the tube 4. A plate 8 welded to the end of the shaft 6 projecting beyond the tube 4 is bolted to a backing plate 9. The latter has welded to it a clamping bar 10 and, as is shown in FIG. 1, a guide pin 11. The tube 4 and the clamping bar 10 are aligned and the guide pin 11 is parallel to the tube 4. A tube 12 rotatably mounted on the guide pin 11 can run up against a setting ring 13 which is clamped to the guide pin 11. A holding plate 14 welded to the tube 12 is in turn welded to a clamping bar 15. In the FIG. 3 position, the clamping bar 15 lies against the clamping bar 10 under its own weight. It can also be swung away from the clamping bar 10 about the axis of the guide pin 11. In the swung-away position, an end 16 of a sack 17 shown in chain-dotted lines can be introduced between these bars. After loosening the plug pin 7, the shaft 6 together with the clamping bar 15 can be turned counter-clockwise through 360°. The clamping bar 15 then assumes the FIG. 3 position which can again be secured against rotation and translation by introducing the plug pin 7 in the holes provided for this purpose. The end 16 of the sack thereby forms a loop which envelops the clamping bar 10 by about 300° and the clamping bar 15 by about 180°.

On lifting the clamping bars 10, 15 by actuating the lifting mechanism of the forklift truck to which the lifting tackle is secured, the movable clamping bar 15 is moved towards the fixed clamping bar 10 by the end of the sack or rather the weight of the sack so that the end of the sack that had been slung about the pair of clamping bars 10, 15 by rotation through about 360° is securely clamped between the two clamping bars and cannot slip out of the clamping hold.

To release the lifting tackle, it is sufficient to deposit the sack and swing the clamping bar 15 back through 360°. When the forklift truck is reversed, the end of the sack leaves the space between the clamping bars and the sack is released.

As is shown in FIGS. 4 to 8, the rotary motion and locking is in that example performed hydraulically, a guide being provided for the pivotable clamping bar that would otherwise be guided by hand.

A clamping bar 110 is freely rotatably mounted in walls 120, 121 of a frame. Between the walls 120, 121 a sprocket 122 is secured to the clamping bar 110 for supporting a roller chain 123. The ends of the roller chain 123 are connected to piston rods 124, 125 of piston-cylinder units 126, 127 which are bolted to the frame of the apparatus. The clamping bar can be turned to the right and to the left by actuating the pressure piston units 127, 126. Further, secured to the clamping bar 110 adjacent the sprocket 122 there is a cam plate 128 having a radially extending cam section 129 against which the end of a lever 130 can abut. The lever 130 is freely rotatably mounted in the walls 120, 121 of the frame. It is pivoted to the piston rod of a piston-cylinder unit 131 of which the cylinder is pivoted to the frame. By actuating the piston-cylinder unit 131, the lever 130 can be lifted off the cam plate 128 and lowered thereon.

A plummer block 132 is secured to the clamping bar 110 and in it there is pivotably mounted a swing arm 133. A clamping bar 115 connected to the swing arm 133 carries a loosely rotatable roller 134 at the end adjacent the wall 121 of the frame. The roller 134 is in contact with a guide cam 135 which is fixed with respect to the frame. It has an upwardly open cam section 135.1 extending over about 270° and, adjoining its right-hand arm, there is a horizontally extending straight edge 135.2. In this example the cam section 135.1 and straight edge 135.2 are made in one piece.

Figure 7:
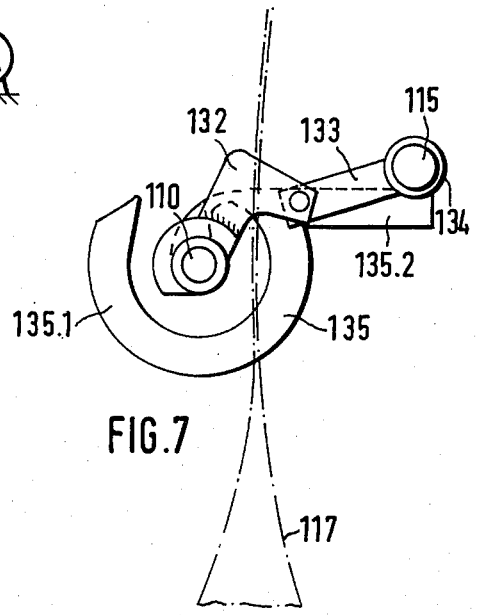
FIG. 7 is an end elevation with the clamping bars open.
Figure 8:
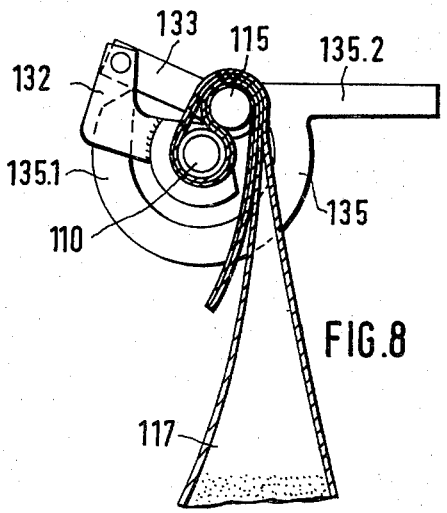
FIG. 8 is an end elevation with the clamping bars closed.

The roller 134 runs along the guide cam 135 in accordance with the rotation of the clamping bar 110. In the outermost position of the clamping bar 110 when turned to the right, the roller lies on the outermost end of the straight edge 135.2. The clamping bar 115 is thereby at a wide spacing from the clamping bar 110 as is shown in FIG. 7, so that the end of the sack 117 can be easily introduced between the two clamping bars.

Figure 3:
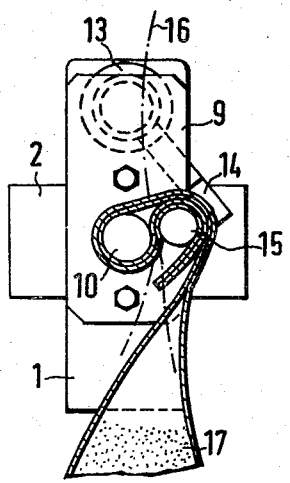
FIG. 3 is an end view of the lifting tackle according to FIG. 1.
Figure 4:
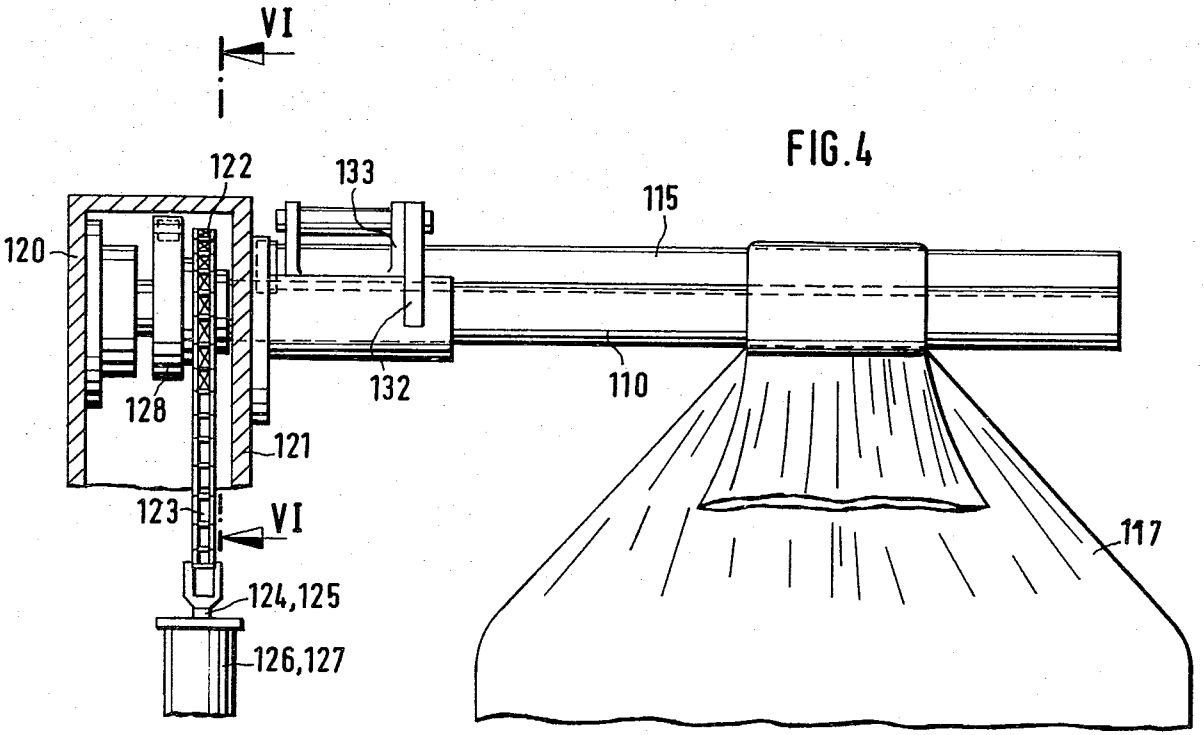
FIG. 4 is a side elevaton of hydraulically actuated lifting tackle.
Figure 5:
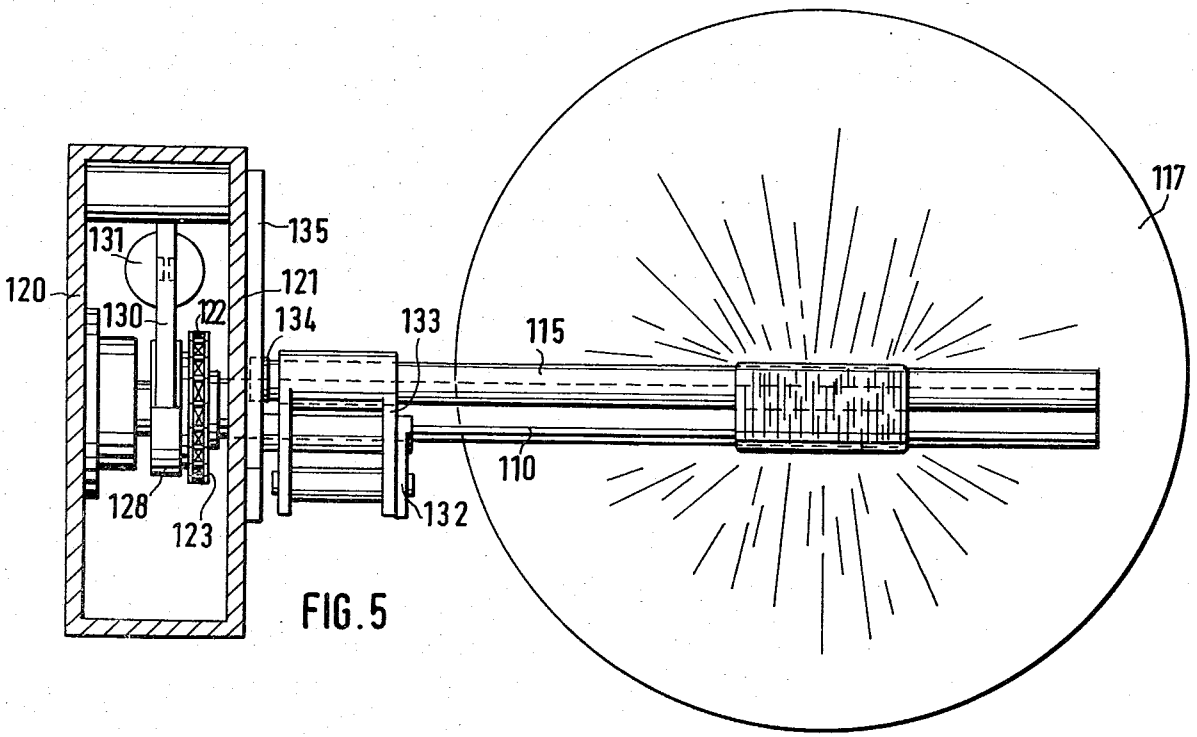
FIG. 5 is a plan view of FIG. 4.
Figure 6:
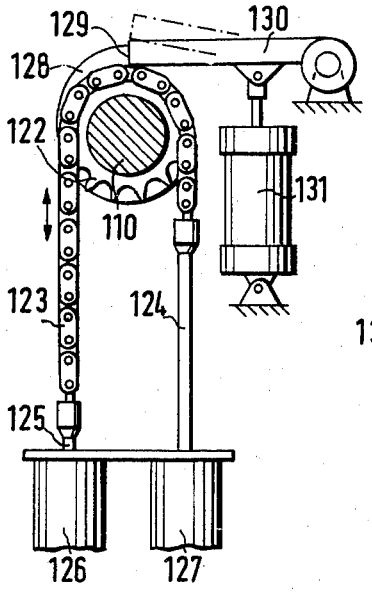
FIG. 6 is a section on the line VI—VI in FIG. 4.

On rotation of the clamping bar 110 in the counter-clockwise direction, the roller 134 moves to the left on the straight edge 135.2 until the clamping bar 115 lies against the clamping bar 110 and turns counter-clockwise about the axis of the clamping bar 110. To keep it in intimate contact with the clamping bar 110, the roller 134 is guided in an arc about the clamping bar 110 by the inner face of the cam section 135.1 until it finally assumes the position shown in FIG. 8. By reason of this motion, the end of the sack is, in the same way as shown in FIG. 3, wound on the clamping bars and securely clamped between them. The clamping bar 110 tends to turn back under the weight of the sack 117. This can be prevented in that the piston-cylinder unit 126 which effects rotation in the counterclockwise direction is continued to be subjected to hydraulic pressure which is suitable for producing a force corresponding to the weight of the sack. In accordance with a different solution here shown, the equipment provided for this purpose is switched on by actuating the piston-cylinder unit 131, whereby the lever 130 is lowered to the FIG. 6 position so that its end abuts the radially extending section 129 of the cam plate 128 and thereby prevents the clamping bar 110 from turning to the right.

To release the sack from the lifting tackle, the lever 130 is first lifted off the cam plate 128 and the clamping bar 110 is turned clockwise by actuating the piston-cylinder unit 127. The roller 134 thereby runs onto the straight edge 135.2 after about 300° of rotation and the clamping bar 115 assumes a wide spacing from the clamping bar 110, whereby the end of the sack 117 can be easily released from the clamping bars.

What we claim is:

1. Apparatus for lifting a filled sack, comprising a frame, a pair of clamping bars about which a gathered and flattened end of the sack is slung, and means for mounting said bars on said frame, the pair of clamping bars being rotatable about an axis parallel to the bars from an initial spaced apart position to a terminal position in which the end of the sack is clamped tight between the bars, one of the clamping bars being displaceable towards the other in parallel relationship, the clamping bars (10, 15); (110, 115) being held in their respective mounting means (4, 120, 121) only on one side such that they form parallel cantilever arms, one of said clamping bars moving toward and rotating about the other of said clamping bars during rotation of the bars from the initial to the terminal position.

2. Apparatus according to claim 1, characterised in that one clamping bar (15, 115) is pivotable about the axis of the other bar (10, 110) and radially movable thereto and is lockable in a closed position when said bars are in said terminal position.

3. Apparatus according to claim 1 or claim 2, wherein a first (10) of said clamping bars is mounted for rotation about its axis, and wherein the mounting means for a second (15) of said clamping bars includes a supporting member (9) connected to said first clamping bar and a lever (14) pivoted to said supporting member, said second clamping bar being secured to said lever.

4. Apparatus according to claim 3, characterised in that the mounting means for the clamping bar rotatable about its axis includes a tube member receiving one end of the clamping bar.

5. Apparatus according to claim 4, characterised in that the terminal position of the pair of clamping bars is securable by a pin (7) for which registering holes are provided in the tube member (4) and in the clamping bar (10) rotatable therein.

6. Apparatus according to claim 1 or claim 2, wherein the mounting means for the other of said clamping bars includes a rotary drive (123-127), and wherein the mounting means for said one clamping bar includes lever means pivotally interconnecting said one and said other clamping bars, a stationary control cam (135) pivotally connected to said one clamping bar, said cam having a substantially linear portion (135.2) supporting said one clamping bar in the initial position and a portion (135.1) which substantially concentrically surrounds said other clamping bar (110) and on which said one clamping bar (115) is guided at a small spacing from said other clamping bar.

7. Apparatus according to claim 6, characterised in that the rotary drive comprises two parallel hydraulic piston-cylinder units (126, 127) having piston rods (124, 125), a chain (123) having ends secured to said rods, and a sprocket (122) secured to the clamping bar (110), said chain running on said sprocket.

8. Apparatus according to claim 7, characterised in that a spiral-shaped cam (128) is provided on the other clamping bar (110) and a stationary pivotably mounted pawl (130) is provided which, in the terminal position of the clamping bars, drops into a step (129) formed by the spiral-shaped cam.

9. Apparatus according to claim 8, characterised in that the pawl (130) is releasable by a hydraulic piston-cylinder unit (131).

* * * * *